US007040354B2

(12) United States Patent
Schwemmlein et al.

(10) Patent No.: US 7,040,354 B2
(45) Date of Patent: May 9, 2006

(54) DEVICE FOR REGULATING THE TENSION OF A THREAD UNWOUND FROM A BOBBIN OF A BOBBIN-HOLDER FOR A LENO SELVEDGE APPARATUS

(75) Inventors: Christoph Schwemmlein, Borken-Weseke (DE); Kurt Hockemeyer, Borken-Weseke (DE)

(73) Assignee: Kloecker-Entwicklungs-GmbH, Borken-Weseke (DE)

( * ) Notice: Subject to any disclaimer, the term of this patent is extended or adjusted under 35 U.S.C. 154(b) by 171 days.

(21) Appl. No.: 10/751,763

(22) Filed: Jan. 5, 2004

(65) Prior Publication Data

US 2004/0154680 A1 Aug. 12, 2004

(30) Foreign Application Priority Data

Jan. 23, 2003 (DE) ..... 103 02 730

(51) Int. Cl.
*D03D 47/40* (2006.01)

(52) U.S. Cl. ..... 139/430; 139/102; 139/106; 28/191

(58) Field of Classification Search ..... 139/430, 139/106, 102; 28/191; 188/65.3; 242/590, 242/563, 129.8, 419.2
See application file for complete search history.

(56) References Cited

U.S. PATENT DOCUMENTS 3,924,820 A * 12/1975 Kovar et al. ..... 242/156
5,524,678 A * 6/1996 Haeussler et al. ..... 139/54
5,988,228 A * 11/1999 Krumm ..... 139/54
5,996,646 A 12/1999 Hockemeyer et al.
6,240,974 B1 * 6/2001 Hehle ..... 139/430
6,244,304 B1 6/2001 Hockemeyer et al.

FOREIGN PATENT DOCUMENTS

| | | |
|---|---|---|
| CH | 347 805 A | 7/1960 |
| DE | 2055700 | 11/1970 |
| DE | 2255819 | 11/1972 |
| DE | 39 11 672 A | 11/1989 |
| DE | 4100173 | 1/1991 |
| DE | 9444507 | 9/1994 |
| EP | 0839219 | 5/1996 |
| EP | 1036228 | 11/1998 |
| GB | 406 931 A | 3/1934 |
| GB | 541 417 A | 11/1941 |

* cited by examiner

*Primary Examiner*—John J. Calvert
*Assistant Examiner*—Robert H Muromoto

(74) *Attorney, Agent, or Firm*—Jordan and Hamburg LLP

(57) ABSTRACT

The subject matter of the invention is a device for regulating the tension of a thread unwound from a bobbin of a bobbin-holder for a leno selvedge apparatus, said device comprising a brake drum for receiving the bobbin-holder, said brake drum having a brake means and the device being provided with a guide arm for the thread of the bobbin, the brake means (4) comprising a pivotable brake lever (10) having a brake shoe (4) resting against the brake drum (1), with the brake lever (10) having a guide arm (20) provided with an eye (21) for passage of the thread (6) unwound from the bobbin (5).

8 Claims, 1 Drawing Sheet

DEVICE FOR REGULATING THE TENSION OF A THREAD UNWOUND FROM A BOBBIN OF A BOBBIN-HOLDER FOR A LENO SELVEDGE APPARATUS

BACKGROUND OF THE INVENTION

1. Field of the Invention

The invention relates to a device for regulating the tension of a thread unwound from a bobbin of a bobbin-holder for a leno selvedge apparatus, said device comprising a brake drum for receiving the bobbin-holder, said brake drum having a brake means and the device being provided with a guide arm for the thread of the bobbin. By way of example, a leno selvedge apparatus is configured as a combination of lifting and half healds. Two lifting healds cooperate thereby with one half heald to produce what is termed a leno selvedge. Such type lifting healds are directly or indirectly secured to the heald frame of a loom. The leno thread is thereby conveyed between half heald and lifting heald, with the stationary thread being passed through the eye of the half heald. As the leno thread alternately moves from one side of the half heald to the other side of the half heald, the weft thread is firmly locked in place together with the stationary thread by the thus produced leno selvedge. The leno selvedge prevents the fabric from fraying in this region.

2. Description of the Prior Art

A device for producing a similar leno selvedge is characterized by two rotating arms that receive at their ends the leno threads, the weft thread being firmly locked in place by the leno threads. This device is also known by the name of "propeller leno device" (EP 0 839 219).

The important point is that the threads that are supplied to the leno selvedge device and that are unwound from a rotating bobbin are in principle always held under a constant and continuous tension. More specifically, the threads are to be prevented from jerking under tension, as delicate threads in particular, glass fiber threads for example, are then likely to break. The risk of such a thread being jerked, which involves the risk of breaking, arises more specifically when, for whatever reason, a tension is applied to the thread, said tension is abruptly slackened and the bobbin continues to rotate, thus forming in a way a thread reserve, which, once used up, causes the thread to be jerked again.

Inasmuch, a device for regulating the thread tension is already known from EP 1 036 228; here there is provided, directly upstream of the leno selvedge device, a holding-down device for the thread which regulates the thread tension already directly upstream of the leno selvedge apparatus. Said holding-down device for the thread is configured to be elastically flexible for the purpose. Disposing this device for regulating the thread tension directly upstream of the leno selvedge device permits to equalize the thread tension under the action of the spring of the holding device when the shed is opened.

The subject matter of the invention now also is a device for regulating the thread tension by equalizing the thread tension directly at the bobbin. Bobbin-holders for rotatably receiving the bobbin are known. Such type bobbin-holders are also known to be provided with brakes that are intended to make sure that the thread is uniformly unwound from the bobbin. It has however been found that the known devices are not always capable of ensuring the uniform unwinding of the thread from the bobbin.

BRIEF SUMMARY OF THE INVENTION

It is therefore the object of the invention to provide a device of the type mentioned herein above that regulates the thread tension by equalizing the tension of the thread unwound from the bobbin.

In accordance with the invention, this object is achieved in that the brake means comprises a pivotable brake lever having a brake shoe resting against the brake drum, with the brake lever having a guide arm provided with an eye for passage of the thread unwound from the bobbin. Said guide arm is more specifically configured to be elastically flexible. The tension of the thread unwound from the bobbin is more specifically equalized by the brake of the brake lever cooperating with the guide arm receiving the thread. This is achieved in that, when a tension is applied to the thread, said tension is taken by the guide arm, which is configured to be elastically flexible, with the brake shoe of the brake lever being concurrently detached from, in extreme cases even lifted off, the brake drum. Meaning, when the threads are under tension, the guide arm, which as already mentioned is elastically flexible, bends in the direction of the action of the force, the brake lever, which, together with the guide arm, forms a unit, being concurrently caused by said force to reduce the force it applies to the brake drum or to lift off so that the brake action on the brake drum is reduced and, in extreme cases, even cancelled. The spring action of the guide arm must hereby correlate the force exerted onto the brake shoe. There may hereby be more specifically provided an adjustable spring which, as a constituent part of the brake means, acts onto the brake shoe. Meaning, it has to be made certain in any event that, when tension peaks are applied to the brake shoe, the guide arm be deflected before the brake shoe is lifted off the brake drum. This makes it possible to adjust the braking force to the specific needs of the thread unwound from the bobbin. It has been found that the construction in accordance with the invention allows regulating the thread tension by equalizing the thread tension.

More specifically, the important point is that the ratio of the spacing between the eye of the guide arm and the center point line of the brake means on the one side and of the fulcrum of the brake lever to the center point line of the brake means on the other side (H2 to H1) be determined and preferably comprised between 9:1 and 12:1, and more preferably be 11:1. The length of the guide arm in turn is a function of the elasticity of the guide arm. The diameter of the brake drum relative to the diameter of the bobbin also has an influence; the ratio of the diameter of the brake drum to the diameter of the full bobbin advantageously is about 3:1. Uniform tension of the thread is also obtained when the brake drum has a uniform surface on its circumference against which the brake shoe is resting.

It is particularly advantageous if the fulcrum of the brake lever lies on a tangent, with the position of the tangent being determined by the intersection of the center point line of the brake drum and the center line of the brake shoes. The center line thereby divides the brake shoe into two equal parts on either side of the center point line of the brake drum. Meaning, the brake shoe extends the same distance on either side of the center point line on the summit of the brake drum. Another advantage of this design more specifically is that in this case, for the brake action, it makes no difference in which direction the brake drum rotates. The brake shoe will not move up or down on the brake drum. The brake action will always remain constant.

Further advantageous features will become apparent upon reading the dependent claims.

The invention will be described in further detail herein after by way of example with reference to the drawings.

DETAILED DESCRIPTION OF THE INVENTION

Figure 1:
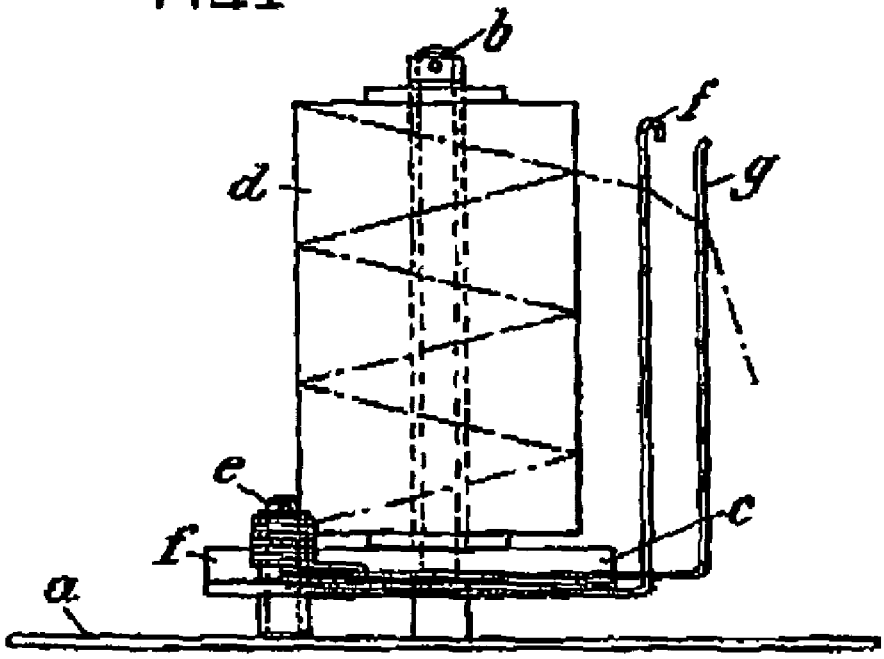
FIG. 1 is a side view of the brake means.
Figure 2:
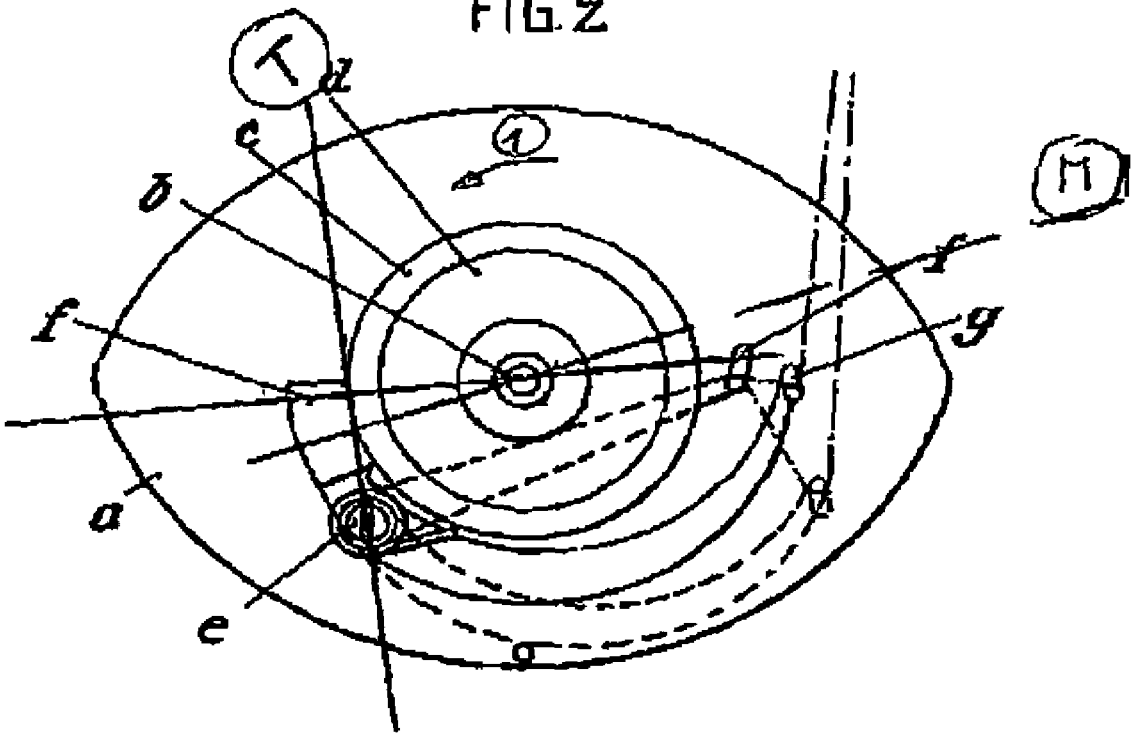
FIG. 2 is a top view thereof.

The brake drum, which is indicated at 1, is rotatably received by a holding device 2, the brake means 4 being retained by means of a bar 3. The brake drum 1 carries the bobbin 5, the thread unwound from the bobbin 5 being labeled at 6. The brake means is indicated generally at 4 and comprises the brake lever 10 that is pivotally carried on the axis 11. The important point now is that the center point of this axis 11 lies on the tangent 12. The tangent 12 touches the surface of the brake drum 1 at the intersection of the center point line 13 of the brake drum 1. Meaning, the same brake surface of the brake shoe 14, which is disposed on the lever 10, is provided on either side of the center point line 13. The lever 10, in turn, is biased by the spring 16, the force of which is adjustable by means of a nut 17 threaded onto a thread end. The brake lever 10 further has the guide arm 20 that is provided at its end with an eye 21 for passing the thread 6.

The functioning of the device will be explained as follows:

If the thread 6 is pulled, the guide arm 20 pivots in the direction of the arrow 30. If the tension applied to the guide arm 20 increases, the lever 10 is pivoted in the direction of arrow 31, with the brake shoe 14 disengaging from the surface of the brake drum, or being lifted off the surface of the brake drum in extreme cases, when the thread tension becomes too great. When the thread tension has slackened, the brake shoe 14 engages again the surface of the brake drum 1 with the tension applied to the guide arm 20 slackening as well and said guide arm returning finally to its initial position.

The important point is that the thread tension be regulated in two steps, by the guide arm 20 on the one side and by the brake lever 10 disengaging or being lifted off or pivoted in the second step on the other side. The adjustment of the time at which braking occurs, or of the time at which the brake shoe or brake lever 10 is finally disengaged from the brake drum or the force applied to the brake drum by the braking force is reduced depends, i.a., on the force of the spring 16, on the surface of the brake drum and on the size of the brake drum, or also on the elasticity of the guide arm 20. The important point for uniform unwinding of the thread also is the ratio of H2 to H1, which preferably is 11:1. More specifically by having the brake lever 10 carried on the tangent 12 described herein above, one achieves that the brake action is always the same irrespective of the direction of rotation of the drum since there is no risk that the brake shoe moves up and down on the drum.

We claim:

1. A device for regulating the tension of a thread unwound from a bobbin of a bobbin-holder for a leno selvedge apparatus, said device comprising:

a brake drum for receiving the bobbin-holder;

said brake drum having a brake means;

the brake means comprising a pivotable brake lever having a brake shoe, said brake shoe resting against the brake drum;

the brake lever having a guide arm provided with an eye for passage of the thread unwound from the bobbin; and a fulcrum of the brake lever being disposed on a tangent, the tangent being disposed at the intersection between the center point line of the brake drum and the center line of the brake shoe.

2. The device according to claim 1, wherein the brake shoe is spring-loaded.

3. The device according to claim 2, wherein the force of the spring of the brake means is adjustable to the brake shoe.

4. The device according to claim 1, wherein a first distance is defined by the spacing between the eye of the guide arm and the center point line of the brake means; and a second distance is defined by the spacing between the fulcrum of the brake lever to the center point line of the brake means; and a ratio of the first distance to the second distance is between 9:1 and 12:1.

5. The device according to claim 1, wherein the guide arm is configured to be elastically flexible.

6. The device according to claim 1, wherein the brake drum has a uniform surface on its circumference against which the brake shoe rest.

7. The device according to claim 1, wherein the diameter of the brake drum is approximately three times the diameter of a full bobbin.

8. A device for regulating the yarn tension of a yarn, the yarn being pulled from a yarn package, the device comprising:

a brake drum which accommodates the yarn package holding device, the brake drum having a braking arrangement, the device having a guiding arm for the yarn of the yarn package, the braking arrangement comprising a pivotable brake lever with a brake shoe lying in contact with the brake drum, the brake lever having a guiding arm with an eye for the yarn pulled off from the package; and a fulcrum of the brake lever being disposed on a tangent, the tangent being disposed at the intersection between a center point line of the brake drum and a center line of the brake shoe.

* * * * *